US011549329B2

(12) United States Patent
Al-Mousa et al.

(10) Patent No.: US 11,549,329 B2
(45) Date of Patent: Jan. 10, 2023

(54) DOWNHOLE CASING-CASING ANNULUS SEALANT INJECTION

(71) Applicant: Saudi Arabian Oil Company, Dhahran (SA)

(72) Inventors: Ahmed Al-Mousa, Dhahran (SA); Ahmed Ghaffar, Dhahran (SA); Omar M Alhamid, Dammam (SA); Marius Neacsu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 45 days.

(21) Appl. No.: 17/131,352

(22) Filed: Dec. 22, 2020

(65) Prior Publication Data

US 2022/0195834 A1 Jun. 23, 2022

(51) Int. Cl.

| | |
|---|---|
| ***E21B 33/14*** | (2006.01) |
| ***E21B 17/10*** | (2006.01) |
| ***E21B 33/138*** | (2006.01) |

(52) U.S. Cl.

CPC ..... *E21B 33/14* (2013.01); *E21B 17/1078* (2013.01); *E21B 33/138* (2013.01)

(58) Field of Classification Search

CPC ..... E21B 33/14; E21B 17/1078; E21B 33/138
See application file for complete search history.

(56) References Cited

U.S. PATENT DOCUMENTS

| | | | |
|---|---|---|---|
| 880,404 | A | 2/1908 | Sanford |
| 1,033,655 | A | 7/1912 | Baker |
| 1,258,273 | A | 3/1918 | Titus et al. |
| 1,392,650 | A | 10/1921 | Mcmillian |
| 1,491,066 | A | 4/1924 | Patrick |
| 1,580,352 | A | 4/1926 | Ercole |
| 1,591,264 | A | 7/1926 | Baash |

(Continued)

FOREIGN PATENT DOCUMENTS

| | | |
|---|---|---|
| AU | 636642 | 5/1993 |
| AU | 2007249417 | 11/2007 |

(Continued)

OTHER PUBLICATIONS

Al-Ansari et al., "Thermal Activated Resin to Avoid Pressure Build-Up in Casing-Casing Annulus (CCA)," SA-175425-MS, Society of Petroleum Engineers (SPE), presented at the SPE Offshore Europe Conference and Exhibition, Sep. 8-11, 2015, 11 pages.

(Continued)

*Primary Examiner* — Aaron L Lembo
(74) *Attorney, Agent, or Firm* — Fish & Richardson P.C.

(57) ABSTRACT

A downhole sealant injection system includes a first casing configured to be positioned in a wellbore and a second casing configured to be positioned in the wellbore within the first casing. Cement at least partially fills an annulus between the interior of the first casing and the exterior of the second casing. A first sealant injection tool is configured to be attached to the exterior of the second casing, and is positioned at a downhole location and within an annulus between the interior of the first casing and the exterior of the second casing. The sealant injection tool includes a plurality of nozzles configured to inject sealant into voids within the cement in the annulus between the interior of the first casing and the exterior of the second casing.

20 Claims, 9 Drawing Sheets

(56) References Cited

U.S. PATENT DOCUMENTS 1,621,947 A 3/1927 Moore
1,638,494 A 8/1927 Lewis et al.
1,789,993 A 1/1931 Switzer
1,896,236 A 2/1933 Howard
1,896,482 A 2/1933 Crowell
1,897,297 A 2/1933 Brown
1,949,498 A 3/1934 Frederick et al.
2,047,774 A 7/1936 Greene
2,121,002 A 6/1938 Baker
2,121,051 A 6/1938 Ragan et al.
2,187,487 A 1/1940 Burt
2,189,697 A 2/1940 Baker
2,222,233 A 11/1940 Mize
2,286,075 A 6/1942 Evans
2,304,793 A 12/1942 Bodine
2,316,402 A 4/1943 Canon
2,327,092 A 8/1943 Botkin
2,377,249 A 5/1945 Lawrence
2,411,260 A 11/1946 Glover et al.
2,481,637 A 9/1949 Yancey
2,546,978 A 4/1951 Collins et al.
2,638,988 A 5/1953 Williams
2,663,370 A 12/1953 Robert et al.
2,672,199 A 3/1954 McKenna
2,701,019 A 2/1955 Steed
2,707,998 A 5/1955 Baker et al.
2,708,973 A 5/1955 Twining
2,728,599 A 12/1955 Moore
2,734,581 A 2/1956 Bonner
2,745,693 A 5/1956 Mcgill
2,751,010 A 6/1956 Trahan
2,762,438 A 9/1956 Naylor
2,778,428 A 1/1957 Baker et al.
2,806,532 A 9/1957 Baker et al.
2,881,838 A 4/1959 Morse et al.
2,887,162 A 5/1959 Le Bus et al.
2,912,053 A 11/1959 Bruekelman
2,912,273 A 11/1959 Chadderdon et al.
2,915,127 A 12/1959 Abendroth
2,947,362 A 8/1960 Smith
2,965,175 A 12/1960 Ransom
2,965,177 A 12/1960 Le Bus et al.
2,965,183 A 12/1960 Le Bus et al.
3,005,506 A 10/1961 Le Bus et al.
3,023,810 A 3/1962 Anderson
3,116,799 A 1/1964 Lemons
3,147,536 A 9/1964 Lamphere
3,225,828 A 12/1965 Wisenbaker et al.
3,255,821 A * 6/1966 Curlet ..... E21B 43/08 166/380
3,308,886 A 3/1967 Evans
3,352,593 A 11/1967 Webb
3,369,603 A 2/1968 Trantham
3,376,934 A 4/1968 William
3,380,528 A 4/1968 Durwood
3,381,748 A 5/1968 Peters et al.
3,382,925 A 5/1968 Jennings
3,437,136 A 4/1969 Young
3,667,721 A 6/1972 Vujasinovic
3,747,674 A 7/1973 Murray
3,752,230 A 8/1973 Bernat et al.
3,897,038 A 7/1975 Le Rouax
3,915,426 A 10/1975 Le Rouax
4,030,354 A 6/1977 Scott
4,039,798 A 8/1977 Lyhall et al.
4,042,019 A 8/1977 Henning
4,059,155 A 11/1977 Greer
4,099,699 A 7/1978 Allen
4,158,388 A * 6/1979 Owen ..... E21B 33/13 166/305.1
4,190,112 A 2/1980 Davis
4,227,573 A 10/1980 Pearce et al.
4,254,983 A 3/1981 Harris
4,276,931 A 7/1981 Murray
4,296,822 A 10/1981 Ormsby
4,349,071 A 9/1982 Fish
4,391,326 A 7/1983 Greenlee
4,407,367 A 10/1983 Kydd
4,412,130 A 10/1983 Winters
4,413,642 A 11/1983 Smith et al.
4,422,948 A 12/1983 Corley et al.
4,467,996 A 8/1984 Baugh
4,515,212 A 5/1985 Krugh
4,538,684 A 9/1985 Sheffield
4,562,888 A 1/1986 Collet
4,603,578 A 8/1986 Stolz
4,616,721 A 10/1986 Furse
4,696,502 A 9/1987 Desai
4,834,184 A 5/1989 Streich et al.
4,836,289 A 6/1989 Young
4,869,321 A 9/1989 Hamilton
4,877,085 A 10/1989 Pullig, Jr.
4,898,245 A 2/1990 Braddick
4,928,762 A 5/1990 Mamke
4,953,617 A 9/1990 Ross et al.
4,997,225 A 3/1991 Denis
5,012,863 A 5/1991 Springer
5,054,833 A 10/1991 Bishop et al.
5,060,737 A 10/1991 Mohn
5,117,909 A * 6/1992 Wilton ..... E21B 43/122 166/387
5,129,956 A 7/1992 Christopher et al.
5,176,208 A 1/1993 Lalande et al.
5,178,219 A 1/1993 Streich et al.
5,197,547 A 3/1993 Morgan
5,203,646 A 4/1993 Landsberger et al.
5,295,541 A 3/1994 Ng et al.
5,330,000 A 7/1994 Givens et al.
5,358,048 A 10/1994 Brooks
5,392,715 A 2/1995 Pelrine
5,456,312 A 10/1995 Lynde et al.
5,507,346 A 4/1996 Gano et al.
5,580,114 A 12/1996 Palmer
5,584,342 A 12/1996 Swinford
5,605,366 A 2/1997 Beeman
5,639,135 A 6/1997 Beeman
5,667,015 A 9/1997 Harestad et al.
5,673,754 A 10/1997 Taylor
5,678,635 A 10/1997 Dunlap et al.
5,685,982 A 11/1997 Foster
5,806,596 A 9/1998 Hardy et al.
5,833,001 A 11/1998 Song et al.
5,842,518 A 12/1998 Soybel et al.
5,881,816 A 3/1999 Wright
5,924,489 A 7/1999 Hatcher
5,944,101 A 8/1999 Hearn
6,070,665 A 6/2000 Singleton et al.
6,112,809 A 9/2000 Angle
6,130,615 A 10/2000 Poteet
6,138,764 A 10/2000 Scarsdale et al.
6,155,428 A 12/2000 Bailey et al.
6,247,542 B1 6/2001 Kruspe et al.
6,276,452 B1 8/2001 Davis et al.
6,371,204 B1 4/2002 Singh et al.
6,378,627 B1 4/2002 Tubel et al.
6,478,086 B1 * 11/2002 Hansen ..... E21B 33/02 166/387
6,491,108 B1 12/2002 Slup et al.
6,510,947 B1 1/2003 Schulte et al.
6,595,289 B2 7/2003 Tumlin et al.
6,637,511 B2 10/2003 Linaker
6,679,330 B1 1/2004 Compton et al.
6,688,386 B2 2/2004 Comelssen
6,698,712 B2 3/2004 Milberger et al.
6,729,392 B2 5/2004 DeBerry et al.
6,768,106 B2 7/2004 Gzara et al.
6,772,839 B1 * 8/2004 Bond ..... E21B 23/04 166/383
6,808,023 B2 10/2004 Smith et al.
6,811,032 B2 11/2004 Schulte et al.
6,880,639 B2 4/2005 Rhodes et al.
6,899,178 B2 5/2005 Tubel
6,913,084 B2 7/2005 Boyd
7,049,272 B2 5/2006 Sinclair et al.

(56) References Cited

U.S. PATENT DOCUMENTS 7,051,810 B2 5/2006 Halliburton
7,096,950 B2 8/2006 Howlett et al.
7,117,956 B2 10/2006 Grattan et al.
7,150,328 B2 12/2006 Marketz et al.
7,188,674 B2 3/2007 McGavem, III et al.
7,188,675 B2 3/2007 Reynolds
7,218,235 B1 5/2007 Rainey
7,231,975 B2 6/2007 Lavaure et al.
7,249,633 B2 7/2007 Ravensbergen et al.
7,275,591 B2 10/2007 Allen et al.
7,284,611 B2 10/2007 Reddy et al.
7,303,010 B2 12/2007 de Guzman et al.
7,398,832 B2 7/2008 Brisco
7,405,182 B2 7/2008 Verrett
7,418,860 B2 9/2008 Austerlitz et al.
7,424,909 B2 9/2008 Roberts et al.
7,488,705 B2 2/2009 Reddy et al.
7,497,260 B2 3/2009 Telfer
7,591,305 B2 9/2009 Brookey et al.
7,600,572 B2 10/2009 Slup et al.
7,617,876 B2 11/2009 Patel et al.
7,621,324 B2 11/2009 Atencio
7,712,527 B2 5/2010 Roddy
7,735,564 B2 6/2010 Guerrero
7,762,323 B2 7/2010 Frazier
7,802,621 B2 9/2010 Richards et al.
7,934,552 B2 5/2011 La Rovere
7,965,175 B2 6/2011 Yamano
8,002,049 B2 8/2011 Keese et al.
8,056,621 B2 11/2011 Ring et al.
8,069,916 B2 12/2011 Giroux et al.
8,201,693 B2 6/2012 Jan
8,210,251 B2 7/2012 Lynde et al.
8,376,051 B2 2/2013 McGrath et al.
8,453,724 B2 6/2013 Zhou
8,496,055 B2 7/2013 Mootoo et al.
8,579,024 B2 11/2013 Mailand et al.
8,596,463 B2 12/2013 Burkhard
8,726,983 B2 5/2014 Khan
8,770,276 B1 7/2014 Nish et al.
8,899,338 B2 12/2014 Elsayed et al.
8,936,097 B2 * 1/2015 Heijnen ..... E21B 43/26 166/305.1
8,991,489 B2 3/2015 Redlinger et al.
9,079,222 B2 7/2015 Burnett et al.
9,109,433 B2 8/2015 DiFoggio et al.
9,133,671 B2 9/2015 Kellner
9,163,469 B2 10/2015 Broussard et al.
9,181,782 B2 11/2015 Berube et al.
9,212,532 B2 12/2015 Leuchtenberg et al.
9,234,394 B2 1/2016 Wheater et al.
9,359,861 B2 6/2016 Burgos
9,410,066 B2 8/2016 Ghassemzadeh
9,416,617 B2 8/2016 Wiese et al.
9,551,200 B2 1/2017 Read et al.
9,574,417 B2 2/2017 Laird et al.
9,657,213 B2 5/2017 Murphy et al.
9,976,407 B2 5/2018 Ash et al.
10,018,011 B2 * 7/2018 Van Dongen ..... E21B 33/14
10,087,752 B2 10/2018 Bedonet
10,198,929 B2 2/2019 Snyder
10,266,698 B2 4/2019 Cano et al.
10,280,706 B1 5/2019 Sharp, III
10,301,898 B2 5/2019 Orban
10,301,989 B2 5/2019 Imada
10,584,546 B1 3/2020 Ford
10,626,698 B2 * 4/2020 Al-Mousa ..... E21B 34/12
10,655,456 B2 * 5/2020 Espe ..... E21B 47/0228
10,837,254 B2 11/2020 Al-Mousa et al.
11,274,515 B2 * 3/2022 Grimsbo ..... E21B 33/13
2002/0053428 A1 5/2002 Maples
2003/0047312 A1 3/2003 Bell
2003/0098064 A1 5/2003 Kohli et al.
2003/0132224 A1 * 7/2003 Spencer ..... E21B 33/138 166/60
2003/0155155 A1 8/2003 Dewey et al.
2004/0040707 A1 3/2004 Dusterhoft et al.
2004/0065446 A1 4/2004 Tran et al.
2004/0074819 A1 4/2004 Burnett
2004/0095248 A1 5/2004 Mandel
2005/0056427 A1 3/2005 Clemens et al.
2005/0167097 A1 8/2005 Sommers et al.
2005/0263282 A1 12/2005 Jeffrey et al.
2006/0082462 A1 4/2006 Crook
2006/0105896 A1 5/2006 Smith et al.
2007/0137528 A1 6/2007 Le Roy-Ddelage et al.
2007/0181304 A1 8/2007 Rankin et al.
2007/0204999 A1 9/2007 Cowie et al.
2007/0256867 A1 11/2007 DeGeare et al.
2008/0087439 A1 4/2008 Dallas
2008/0236841 A1 10/2008 Howlett et al.
2008/0251253 A1 10/2008 Lumbye
2008/0314591 A1 12/2008 Hales et al.
2009/0194290 A1 8/2009 Parks et al.
2009/0250220 A1 10/2009 Stamoulis
2010/0258289 A1 10/2010 Lynde et al.
2010/0263856 A1 10/2010 Lynde et al.
2010/0270018 A1 10/2010 Howlett
2011/0036570 A1 2/2011 La Rovere et al.
2011/0056681 A1 3/2011 Khan
2011/0067869 A1 3/2011 Bour et al.
2011/0168411 A1 7/2011 Braddick
2011/0203794 A1 8/2011 Moffitt et al.
2011/0259609 A1 10/2011 Hessels et al.
2011/0273291 A1 11/2011 Adams
2011/0278021 A1 11/2011 Travis et al.
2012/0012335 A1 1/2012 White et al.
2012/0067447 A1 3/2012 Ryan et al.
2012/0118571 A1 5/2012 Zhou
2012/0170406 A1 7/2012 DiFoggio et al.
2012/0285684 A1 11/2012 Crow et al.
2013/0134704 A1 5/2013 Klimack
2013/0213654 A1 8/2013 Dewey et al.
2013/0240207 A1 9/2013 Frazier
2013/0269097 A1 10/2013 Alammari
2013/0296199 A1 11/2013 Ghassemzadeh
2014/0138091 A1 5/2014 Fuhst
2014/0158350 A1 6/2014 Castillo et al.
2014/0231068 A1 8/2014 Isaksen
2014/0251616 A1 9/2014 O'Rourke et al.
2014/0311756 A1 * 10/2014 Dicke ..... C23C 12/00 427/236
2015/0013994 A1 1/2015 Bailey et al.
2015/0021028 A1 * 1/2015 Boekholtz ..... C09K 8/508 507/221
2015/0096738 A1 4/2015 Atencio
2015/0198009 A1 * 7/2015 Bexte ..... E21B 29/002 166/290
2016/0076327 A1 3/2016 Glaser et al.
2016/0084034 A1 3/2016 Roane et al.
2016/0130914 A1 5/2016 Steele
2016/0160106 A1 6/2016 Jamison et al.
2016/0177637 A1 * 6/2016 Fleckenstein ..... E21B 17/22 166/380
2016/0237810 A1 8/2016 Beaman et al.
2016/0281458 A1 9/2016 Greenlee
2016/0305215 A1 10/2016 Harris et al.
2016/0340994 A1 11/2016 Ferguson et al.
2017/0009554 A1 * 1/2017 Surjaatmadja ..... E21B 43/114
2017/0044864 A1 2/2017 Sabins et al.
2017/0058628 A1 3/2017 Wijk et al.
2017/0067313 A1 3/2017 Connell et al.
2017/0089166 A1 3/2017 Sullivan
2018/0010418 A1 1/2018 VanLue
2018/0030809 A1 2/2018 Harestad et al.
2018/0187498 A1 7/2018 Soto et al.
2018/0209565 A1 7/2018 Lingnau
2018/0216438 A1 * 8/2018 Sewell ..... E21B 43/26
2018/0245427 A1 8/2018 Jimenez et al.
2018/0252069 A1 9/2018 Abdollah et al.
2018/0363407 A1 * 12/2018 Kunz ..... E21B 34/10
2019/0024473 A1 1/2019 Arefi
2019/0049017 A1 2/2019 McAdam et al.
2019/0087548 A1 3/2019 Bennett et al.

(56) References Cited

U.S. PATENT DOCUMENTS

| | | | | |
|---|---|---|---|---|
| 2019/0186232 | A1 | 6/2019 | Ingram | |
| 2019/0203551 | A1 | 7/2019 | Davis et al. | |
| 2019/0284894 | A1 | 9/2019 | Schmidt et al. | |
| 2019/0284898 | A1 | 9/2019 | Fagna et al. | |
| 2019/0316424 | A1 | 10/2019 | Robichaux et al. | |
| 2019/0338615 | A1 | 11/2019 | Landry | |
| 2020/0032604 | A1 | 1/2020 | Al-Ramadhan | |
| 2020/0040707 | A1 | 2/2020 | Watts et al. | |
| 2020/0056446 | A1 | 2/2020 | Al-Mousa et al. | |
| 2020/0325746 | A1* | 10/2020 | Lerbrekk | E21B 33/13 |
| 2021/0285306 | A1* | 9/2021 | Al Mulhem | E21B 33/13 |
| 2021/0388693 | A1* | 12/2021 | Machocki | E21B 33/13 |
| 2022/0098949 | A1* | 3/2022 | Grimsbo | E21B 33/126 |

FOREIGN PATENT DOCUMENTS

| | | | | |
|---|---|---|---|---|
| CA | 2441138 | | 3/2004 | |
| CA | 2734032 | | 6/2016 | |
| CN | 203292820 | | 11/2013 | |
| CN | 103785923 | | 6/2016 | |
| CN | 104712320 | | 12/2016 | |
| CN | 107060679 | | 8/2017 | |
| CN | 107191152 | | 9/2017 | |
| CN | 107227939 | | 10/2017 | |
| CN | 110998059 | A * | 4/2020 | E21B 17/1028 |
| DK | 2545245 | | 4/2017 | |
| DK | 2236742 | | 8/2017 | |
| EP | 0622522 | | 11/1994 | |
| EP | 2964874 | | 1/2016 | |
| EP | 2545245 | | 4/2017 | |
| GB | 958734 | | 5/1964 | |
| GB | 2356415 | | 5/2001 | |
| GB | 2392183 | | 2/2004 | |
| GB | 2414586 | | 11/2005 | |
| GB | 2425138 | | 10/2006 | |
| GB | 2453279 | | 1/2009 | |
| GB | 2492663 | | 1/2014 | |
| GB | 2548768 | A * | 9/2017 | E21B 43/08 |
| OA | 5503 | A | 4/1981 | |
| WO | WO 1989012728 | | 12/1989 | |
| WO | WO 1996039570 | | 12/1996 | |
| WO | WO 2002090711 | | 11/2002 | |
| WO | WO 2008106639 | | 9/2008 | |
| WO | WO 2010132807 | | 11/2010 | |
| WO | WO 2012164023 | | 12/2012 | |
| WO | WO 2013109248 | | 7/2013 | |
| WO | WO 2015112022 | | 7/2015 | |
| WO | WO 2016011085 | | 1/2016 | |
| WO | WO 2016040310 | | 3/2016 | |
| WO | WO-2016123166 | A1 * | 8/2016 | E21B 29/002 |
| WO | WO 2016140807 | | 9/2016 | |
| WO | WO 2017043977 | | 3/2017 | |
| WO | WO-2017173540 | A1 * | 10/2017 | E21B 27/02 |
| WO | WO 2018017104 | | 1/2018 | |
| WO | WO-2018034672 | A1 * | 2/2018 | E21B 33/138 |
| WO | WO 2018164680 | | 9/2018 | |
| WO | WO 2019027830 | | 2/2019 | |
| WO | WO 2019132877 | | 7/2019 | |
| WO | WO 2019231679 | | 12/2019 | |
| WO | WO-2021107937 | A1 * | 6/2021 | C04B 14/06 |
| WO | WO-2021145902 | A1 * | 7/2021 | E21B 17/1078 |
| WO | WO-2022025942 | A1 * | 2/2022 | E21B 21/003 |

OTHER PUBLICATIONS

Al-Ibrahim et al., "Automated Cyclostratigraphic Analysis in Carbonate Mudrocks Using Borehole Images," Article #41425, posted presented at the 2014 AAPG Annual Convention and Exhibition, Search and Discovery, Apr. 6-9, 2014, 4 pages.

Bautista et al., "Probability-based Dynamic TimeWarping for Gesture Recognition on RGB-D data," WDIA 2012: Advances in Depth Image Analysis and Application, 126-135, International Workshop on Depth Image Analysis and Applications, 2012, 11 pages.

Boriah et al., "Similarity Measures for Categorical Data: A Comparative Evaluation," presented at the SIAM International Conference on Data Mining, SDM 2008, Apr. 24-26, 2008, 12 pages.

Bruton et al., "Whipstock Options for Sidetracking," Oilfield Review, Spring 2014, 26:1, 10 pages.

Edwards et al., "Assessing Uncertainty in Stratigraphic Correlation: A Stochastic Method Based on Dynamic Time Warping," RM13, Second EAGE Integrated Reservoir Modelling Conference, Nov. 16-19, 2014, 2 pages.

Edwards, "Constructionde modèles stratigraphiques à partir de données éparses," Stratigraphie, Université de Lorraine, 2017, 133 pages, English abstract.

Fischer, "The Lofer Cyclothems of the Alpine Triassic," published in Merriam, Symposium on Cyclic Sedimentation: Kansas Geological Survey (KGS), Bulletin, 1964, 169: 107-149, 50 pages.

Hernandez-Vela et al., "Probability-based Dynamic Time Warping and Bag-of-Visual-and-Depth-Words for human Gesture Recognition in RGB-D," Pattern Recognition Letters, 2014, 50: 112-121, 10 pages.

Herrera and Bann, "Guided seismic-to-well tying based on dynamic time warping," SEG Las Vegas 2012 Annual Meeting, Nov. 2012, 6 pages.

Keogh and Ratanamahatana, "Exact indexing of dynamic time warping," Knowledge and Information Systems, Springer-Verlag London Ltd., 2004, 29 pages.

Lallier et al., "3D Stochastic Stratigraphic Well Correlation of Carbonate Ramp Systems," IPTC 14046, International Petroleum Technology Conference (IPTC), presented at the International Petroleum Technology Conference, Dec. 7-9, 2009, 5 pages.

Lallier et al., "Management of ambiguities in magnetostratigraphic correlation," Earth and Planetary Science Letters, 2013, 371-372: 26-36, 11 pages.

Lallier et al., "Uncertainty assessment in the stratigraphic well correlation of a carbonate ramp: Method and application of the Beausset Basin, SE France," C. R. Geoscience, 2016, 348: 499-509, 11 pages.

Lineman et al., "Well to Well Log Correlation Using Knowledge-Based Systems and Dynamic Depth Warping," SPWLA Twenty-Eighth Annual Logging Symposium, Jun. 29-Jul. 2, 1987, 25 pages.

Nakanishi and Nakagawa, "Speaker-Independent Word Recognition by Less Cost and Stochastic Dynamic Time Warping Method," ISCA Archive, European Conference on Speech Technology, Sep. 1987, 4 pages.

Pels et al., "Automated biostratigraphic correlation of palynological records on the basis of shapes of pollen curves and evaluation of next-best solutions," Paleogeography, Paleoclimatology, Paleoecology, 1996, 124: 17-37, 21 pages.

Pollack et al., "Automatic Well Log Correlation," AAPG Annual Convention and Exhibition, Apr. 3, 2017, 1 page, Abstract Only.

Rudman and Lankston, "Stratigraphic Correlation of Well Logs by Computer Techniques," The American Association of Petroleum Geologists, Mar. 1973, 53:3 (557-588), 12 pages.

Sakoe and Chiba, "Dynamic Programming Algorithm Optimization for Spoken Word Recognition," IEEE Transactions on Acoustics, Speech and Signal Processing, ASSP-26:1, Feb. 1978, 7 pages.

Salvador and Chan, "FastDTW: Toward Accurate Dynamic Time Warping in Linear Time and Space," presented at the KDD Workshop on Mining Temporal and Sequential Data, Intelligent Data Analysis, Jan. 2004, 11:5 (70-80), 11 pages.

Say hi, "peakdet: Peak detection using MATLAB," Jul. 2012, 4 pages.

Scribd.com [online], "Milling Practices and Procedures," retrieved from URL <https://www.scribd.com/document/358420338/Milling-Rev-2-Secured>, 80 pages.

Silva and Koegh, "Prefix and Suffix Invariant Dynamic Time Warping," IEEE Computer Society, presented at the IEEE 16th International Conference on Data Mining, 2016, 6 pages.

Smith and Waterman, "New Stratigraphic Correlation Techniques," Journal of Geology, 1980, 88: 451-457, 8 pages.

Startzman and Kuo, "A Rule-Based System for Well Log Correlation," SPE Formative Evaluation, Society of Petroleum Engineers (SPE), Sep. 1987, 9 pages.

(56) References Cited

OTHER PUBLICATIONS

TAM International Inflatable and Swellable Packers, "TAM Scab Liner brochure," Tam International, available on or before Nov. 15, 2016, 4 pages.
Tomasi et al., "Correlation optimized warping and dynamic time warping as preprocessing methods for chromatographic data," Journal of Chemometrics, 2004, 18: 231-241, 11 pages.
Uchida et al., "Non-Markovian Dynamic Time Warping," presented at the 21st International Conference on Pattern Recognition (ICPR), Nov. 11-15, 2012, 4 pages.
Waterman and Raymond, "The Match Game: New Stratigraphic Correlation Algorithms," Mathematical Geology, 1987, 19:2, 19 pages.
Weatherford, "Micro-Seal Isolation System-Bow (MSIS-B)," Weatherford Swellable Well Construction Products, Brochure, 2009-2011, 2 pages.
Zoraster et al., "Curve Alignment for Well-to-Well Log Correlation," SPE 90471, Society of Petroleum Engineers (SPE), presented at the SPE Annual Technical Conference and Exhibition, Sep. 26-29, 2004, 6 pages.
PCT International Search Report and Written Opinion in International Appln. No. PCT/US2021/064294, dated Mar. 21, 2022, 16 pages.

* cited by examiner

DOWNHOLE CASING-CASING ANNULUS SEALANT INJECTION

TECHNICAL FIELD

This disclosure relates to wellbore drilling and completion.

BACKGROUND

In hydrocarbon production, a wellbore is drilled into a hydrocarbon-rich geological formation. After the wellbore is partially or completely drilled, a completion system is installed to secure the wellbore in preparation for production or injection. The completion system can include a series of casings or liners cemented in the wellbore to help control the well and maintain well integrity.

SUMMARY

An embodiment disclosed herein provides a downhole sealant injection system. The system includes a first casing configured to be positioned in a wellbore and a second casing configured to be positioned in the wellbore within the first casing. Cement at least partially fills an annulus between the interior of the first casing and the exterior of the second casing. A first sealant injection tool is configured to be attached to the exterior of the second casing, and is positioned at a downhole location and within an annulus between the interior of the first casing and the exterior of the second casing. The sealant injection tool includes a plurality of nozzles configured to inject sealant into voids within the cement in the annulus between the interior of the first casing and the exterior of the second casing.

An aspect combinable with any of the other aspects can include the following features. At least a portion of the plurality of nozzles are defined in at least one of a plurality of centralizer arms.

An aspect combinable with any of the other aspects can include the following features. The centralizer arms are hollow, and an interior of the nozzles is fluidically connected to an interior of the centralizer arms.

An aspect combinable with any of the other aspects can include the following features. A second sealant injection tool is attached to the exterior of the second casing. The second sealant injection tool comprising a second plurality of nozzles configured to inject sealant into voids within the cement in the annulus between the interior of the first casing and the exterior of the second casing.

An aspect combinable with any of the other aspects can include the following features. A first control line is configured to flow sealant from a surface control system to the first sealant injection tool.

An aspect combinable with any of the other aspects can include the following features. A second control line is configured to flow sealant from the surface control system to the second sealant injection tool.

An aspect combinable with any of the other aspects can include the following features. The nozzles comprise burst discs configured to flow sealant upon an exceedance of a burst pressure.

An aspect combinable with any of the other aspects can include the following features. The sealant comprises a resin.

Certain aspects of the subject matter described here can be implemented as a sealant injection tool. The tool includes clamps configured to be attached to the exterior of a casing.

The casing is configured to be placed within a wellbore. A plurality of centralizer arms are attached to the clamps and extend radially outward from the straps and the casing. A plurality of nozzles are defined in the centralizer arms and are configured to inject sealant into a space exterior of the casing within the wellbore.

An aspect combinable with any of the other aspects can include the following features. The centralizer arms are hollow, and an interior of the nozzles is fluidically connected to an interior of the centralizer arms.

An aspect combinable with any of the other aspects can include the following features. The nozzles include burst discs configured to flow sealant upon an exceedance of a burst pressure.

An aspect combinable with any of the other aspects can include the following features. A first subset of the plurality of nozzles points outward away from the casing and a second subset of the plurality of nozzles points inward towards the casing.

An aspect combinable with any of the other aspects can include the following features. The sealant comprises a resin.

Certain aspects of the subject matter described here can be implemented as a method of sealing an annulus between a first casing and a second casing. The first casing is positioned within a wellbore. A first sealant injection tool is attached to the exterior of the second casing. The sealant injection tool includes a plurality of nozzles. The second casing and the sealant injection tool are lowered into the wellbore within the first casing. Cement is flowed into an annulus between the interior of the first casing and the exterior of the second casing. Sealant is injected from the nozzles. The sealant fills voids within the cement in the annulus between the interior of the first casing and the exterior of the second casing.

An aspect combinable with any of the other aspects can include the following features. A downhole end of a first control line is configured to be fluidically connected to the first sealant injection tool. An uphole end of the first control line is fluidically connected to a surface control system.

An aspect combinable with any of the other aspects can include the following features. Sealant is flowed from the surface control system through the first control line.

An aspect combinable with any of the other aspects can include the following features. A second sealant injection tool is attached to the exterior of the second casing. The second sealant injection tool includes a second plurality of nozzles configured to inject sealant into voids within the cement in the annulus between the interior of the first casing and the exterior of the second casing.

An aspect combinable with any of the other aspects can include the following features. A downhole end of a second control line is configured to fluidically connect to the second sealant injection tool. An uphole end of the second control line is fluidically connected to a surface control system.

An aspect combinable with any of the other aspects can include the following features. The nozzles include burst discs. Pressure is applied to the first control line sufficient to burst the burst discs.

An aspect combinable with any of the other aspects can include the following features. The sealant includes a resin.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes a system, tool, and method for sealing cracks, fractures, or other openings in a wellbore, for example, in a cemented annulus adjacent a casing of the wellbore. Many wellbores include a casing that lines at least a portion of a length of the wellbore, and cement that fills an annulus formed between the casing and another outer cylindrical wall, such as the wellbore wall or another casing. Cement is prone to cracking and wear over time due to a poor cement bond, thermal stress, or other factors. This can create an undesirable condition such as cracks, fissures, or microannuli which can provide a path for high-pressure fluids to migrate from deeper strata to lower-pressure strata or to the surface.

The system includes an injection tool positioned downhole and attached to the exterior of a casing, within the annulus formed between the inner casing and an outer casing. The tool is fluidically connected to one or more control lines which are operable to inject resin or other sealing fluid from the surface down to the tool.

In some embodiments, the tool includes a plurality of nozzles with burst discs operable to inject resin or other sealing fluid into the annulus. Such sealant injection can be referred to as a "squeeze job." The nozzles in some embodiments are positioned along centralizer arms attached to the tool and are circumferentially disposed about the tool to distribute the sealing fluid evenly within the annulus. The tool is configured to evenly distribute the sealing fluid in the annular space the annulus. The timing, composition, and amount of injected sealing fluid can be controlled from the surface. In this way, cracks, fissures, or microannuli in the cement are filled with the sealant material and undesirable pressure or fluid migration to the surface via the casing-casing annulus is eliminated or minimized.

Figure 1:
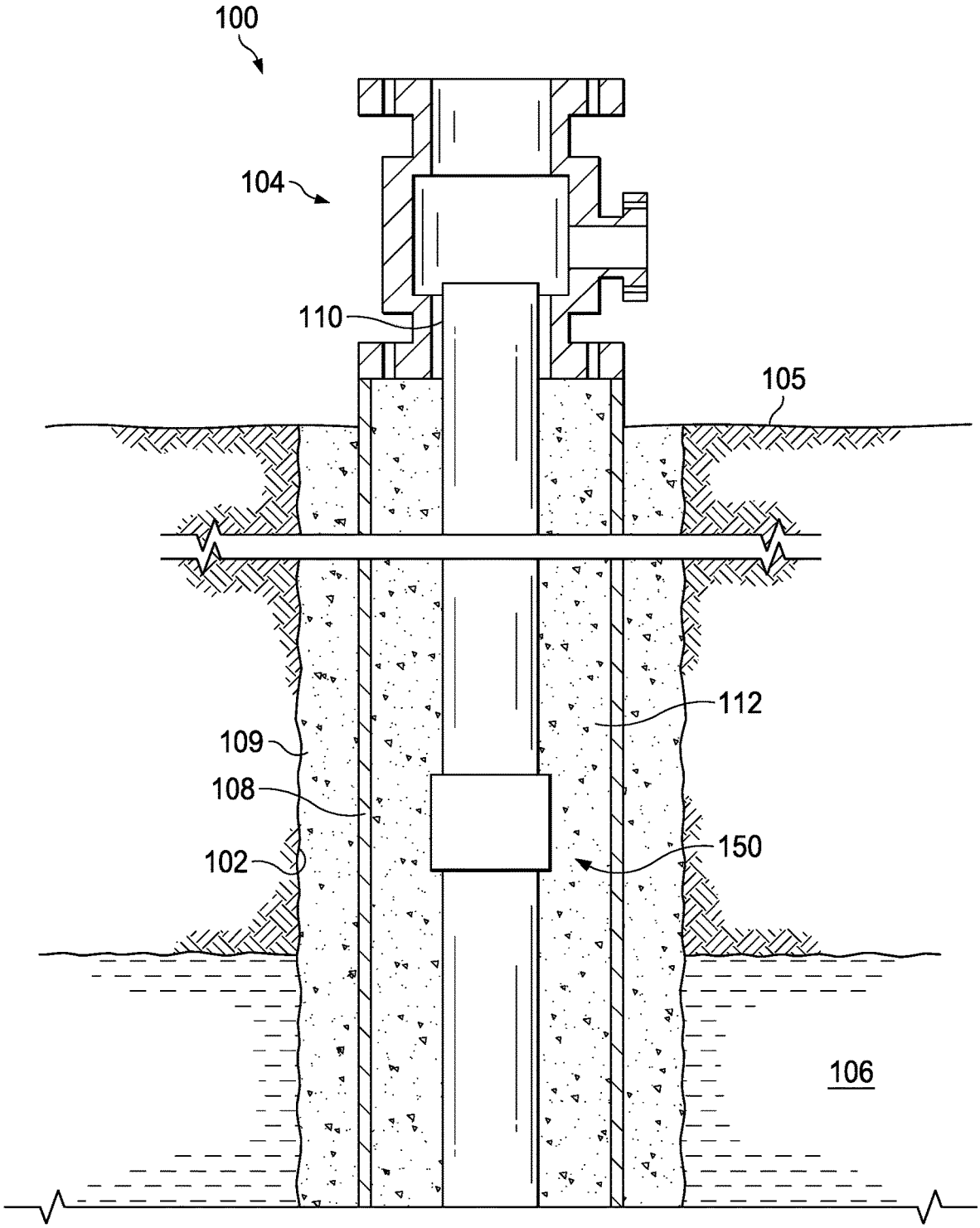
FIG. 1 is a drawing of an exemplary well system in accordance with an embodiment of the present disclosure.

FIG. 1 is a schematic partial cross-sectional side view of an example well system 100 that includes a substantially cylindrical wellbore 102 extending from a wellhead 104 at a surface 105 downward into the Earth into one or more subterranean zones of interest. The example well system 100 shows one subterranean zone 106; however, the example well system 100 can include more than one zone. The well system 100 includes a vertical well, with the wellbore 102 extending substantially vertically from the surface 105 to the subterranean zone 106. The concepts described here, however, are applicable to many different configurations of wells, including vertical, horizontal, slanted, or otherwise deviated wells.

The wellhead 104 defines an attachment point for other equipment of the well system 100 to attach to the well 102. For example, the wellhead 104 can include a Christmas tree structure including valves used to regulate flow into or out of the wellbore 102, or other structures incorporated in the wellhead 104.

After some or all of the wellbore 102 is drilled, a portion of the wellbore 102 extending from the wellhead 104 to the subterranean zone 106 can be lined with lengths of tubing, called casing or liner. The wellbore 102 can be drilled in stages, the casing can be installed between stages, and cementing operations can be performed to inject cement in stages between the casing and a cylindrical wall positioned radially outward from the casing. The cylindrical wall can be an inner wall of the wellbore 102 such that the cement is disposed between the casing and the wellbore wall, the cylindrical wall can be a second casing such that the cement is disposed between the two tubular casings, or the cylindrical wall can be a different substantially tubular or cylindrical surface radially outward of the casing. In the example well system 100 of FIG. 1, the system 100 includes a first, outer liner or casing 108, such as a surface casing, defined by lengths of tubing lining a first portion of the wellbore 102 extending from the surface 105 into the Earth. Outer casing 108 is shown as extending only partially down the wellbore 102 and into the subterranean zone 106; however, the outer casing 108 can extend further into the wellbore 102 or end further uphole in the wellbore 102 than what is shown schematically in FIG. 1.

A first annulus 109, radially outward of the outer casing 108 between the outer casing 108 and an inner wall of the wellbore 102, is shown as filled with cement. The example well system 100 also includes a second, inner liner or casing 110 positioned radially inward from the outer casing 108 and defined by lengths of tubing lining a second portion of the wellbore 102 that extends further downhole of the wellbore 102 than the first casing 108. The inner casing 110 is shown as extending only partially down the wellbore 102 and into the subterranean zone 106, with a remainder of the wellbore 102 shown as open-hole (for example, without a liner or casing); however, the inner casing 110 can extend further into the wellbore 102 or end further uphole in the wellbore 102 than what is shown schematically in FIG. 1.

A second annulus 112, radially outward of the inner casing 110 and between the outer casing 108 and the inner casing 110, is shown as filled with cement. The second annulus 112 can be filled partly or completely with cement. This second annulus 112 can be referred to as a casing-casing annulus, because it is an annulus between two tubular casings in a wellbore.

While FIG. 1 shows the example well system 100 as including two casings (outer casing 108 and inner casing 110), the well system 100 can include more casings, such as three, four, or more casings.

Cracks and fissures can develop in the annular cement due to a poor cement bond, thermal stress, or other factors. This can create an undesirable condition as such cracks and fissures can provide a path for high-pressure fluids to migrate from deeper strata to lower-pressure strata or to the surface. Sealing the annular channels that can provide a path for the migration of fluid through the casing-casing annulus 112. Sealant injection tool 150 is configured to inject resin or another sealant into casing-casing annulus 112 so as to fill such cracks, microannuli, or other voids within the cement filling casing-casing annulus 112. Sealant injection tool 150 is described in more detail in reference to FIG. 2. As described in more detail in FIGS. 3-5, sealant can be flowed from a surface control system to the sealant injection tool 150 via one or more control lines which extend from the surface control system down to the sealant injection tool 150. A suitable sealant can be resin such as WellLock resin or ThermaSet resin or other particle-free fluid with an adjustable thickening time and high bonding strength.

Figure 2:
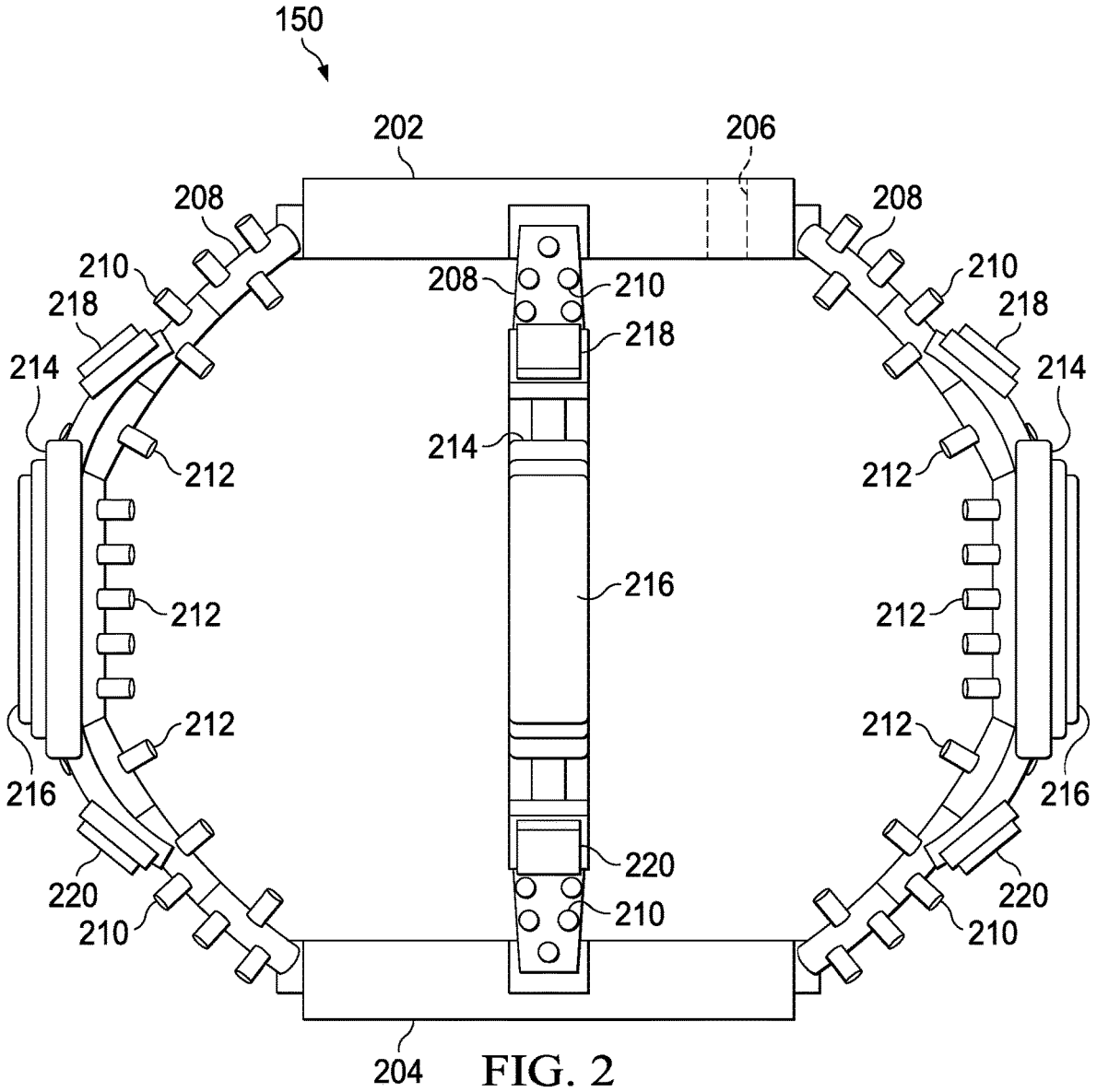
FIG. 2 is a drawing of an exemplary sealant injection tool in accordance with an embodiment of the present disclosure.

FIG. 2 shows an exemplary sealant injection tool 150 in accordance with an embodiment of the present disclosure. Referring to FIG. 2, tool 150 comprises upper clamp 202 and lower claim 204. Clamps 202 and 204 are circular in shape and are configured to be attachable to the exterior of a cylindrical casing (for example, inner casing 110 of FIG. 1). In the illustrated embodiment, clamps 202 and 204 have a hollow interior. Tool 150 can be comprised of stainless steel or another suitable material.

An inlet port 206 allows for a fluid such as resin to be injected into the hollow interior of upper clamp 202. Clamps 202 and 204 are connected by centralizer arms 208. Centralizer arms 208 likewise comprise a hollow interior, and the hollow interior of clamps 202 and 204 are fluidically connected to the hollow interiors of centralizer arms 208. In the illustrated embodiment, tool 150 comprises four centralizer arms 208, each separated by 90° circumferentially about clamps 202 and 204. Other embodiments can include a different number of centralizer arms 208, for example, six or eight arms. In one embodiment of the present disclosure, the number of arms can preferentially depend on the size of the casing. For example, four arms 90° apart from each other can be suitable for a 7" production casing. In the case of large casing sizes like a 9⅝" casing, the number of arms can be increased to six arms (60° apart) or eight arms (45° apart) to provide more radial coverage.

Each of centralizer arms 208 further comprise a plurality of outer nozzles 210 and a plurality of inner nozzles 212. In one embodiment, each centralizer arm 208 comprises a total of ten nozzles 210 and 212. In other embodiments, each centralizer arm 208 can comprise fewer or more nozzles. For example, approximately ten nozzles can be suitable for a 7" casing, whereas a higher number such as fifteen nozzles can be suitable for a larger casing, such as a 9⅝" casing, so as to better distribute the sealant in the annulus.

Outer nozzles 210 extend radially outward from centralizer arms 208, and inner nozzles 212 extend radially inward from centralizer arms 208. Nozzles 210 and 212 are hollow and are fluidically connected to the hollow interior of their respective centralizer arms 208. The ends of nozzles 210 and 212 comprise burst discs configured to rupture when the interior pressure exceeds a predetermined amount. In one embodiment of the present disclosure, a burst pressure of the nozzles is chosen based on the collapse pressure of the host casing and the burst pressure of the outer casing. For typical 13⅜"×9⅝" casing-casing annulus, a suitable burst pressure of the nozzles can be approximately 4500 psi.

In the illustrated embodiment, centralizer arms 208 have an arcuate shape such that they extend radially outward in an arc from clamps 202 and 204. In other embodiments, centralizer arms can have a different shape, such as trapezoidal. In addition to the injection function, centralizer arms 208 act as bowsprings to keep the casing or liner in the center of the wellbore to help ensure efficient placement of the cement sheath around the casing string. In still other embodiments, tool 150 does not comprise centralizer arms but can instead comprise nozzles extending from another portion or portions of tool 150, for example from one or both of clamps 202 or 204.

In the illustrated embodiment, each of the centralizer arms 208 further comprise a protector assembly 214 located at the radially outmost central portions of the arms 208. Protector assembly 214 comprises side protector plates 216, upper protector plates 218, and lower protector plates 220. Protector plates 216, 218, and 220 are comprised of high-grade stainless steel, titanium alloy, or another suitable material and are configured such that, when tool 150 is positioned within a casing or other tubular, protector plates 216, 218, and/or 220 contact the interior surface of the casing and protect outer nozzles 210 and the other portions of centralizer arms 208 from impact and/or friction caused by contact between the interior surface of the casing and the centralizer arms 208.

Tool 150 is configured such that a fluid (for example, resin) can be injected into inlet port 206 and will fill the hollow interiors of upper clamps 202, centralizer arms 208, and lower clamp 204. In one embodiment, the burst discs at the end of nozzles 210 and 212 are configured to rupture when the interior pressure exceeds a predetermined amount. When the discs are ruptured, the resin or other injected fluid exits the nozzles 210 and 212.

The distribution of centralizer arms 208 evenly from each other about the circumference of the casing (90° apart in the illustrated embodiment) and the distribution of the plurality of outer nozzles 210 facing outwards and the plurality of inner nozzles 212 facing inwards, distribute the resin evenly as it fills the space around centralizer arms 208.

Figure 3:
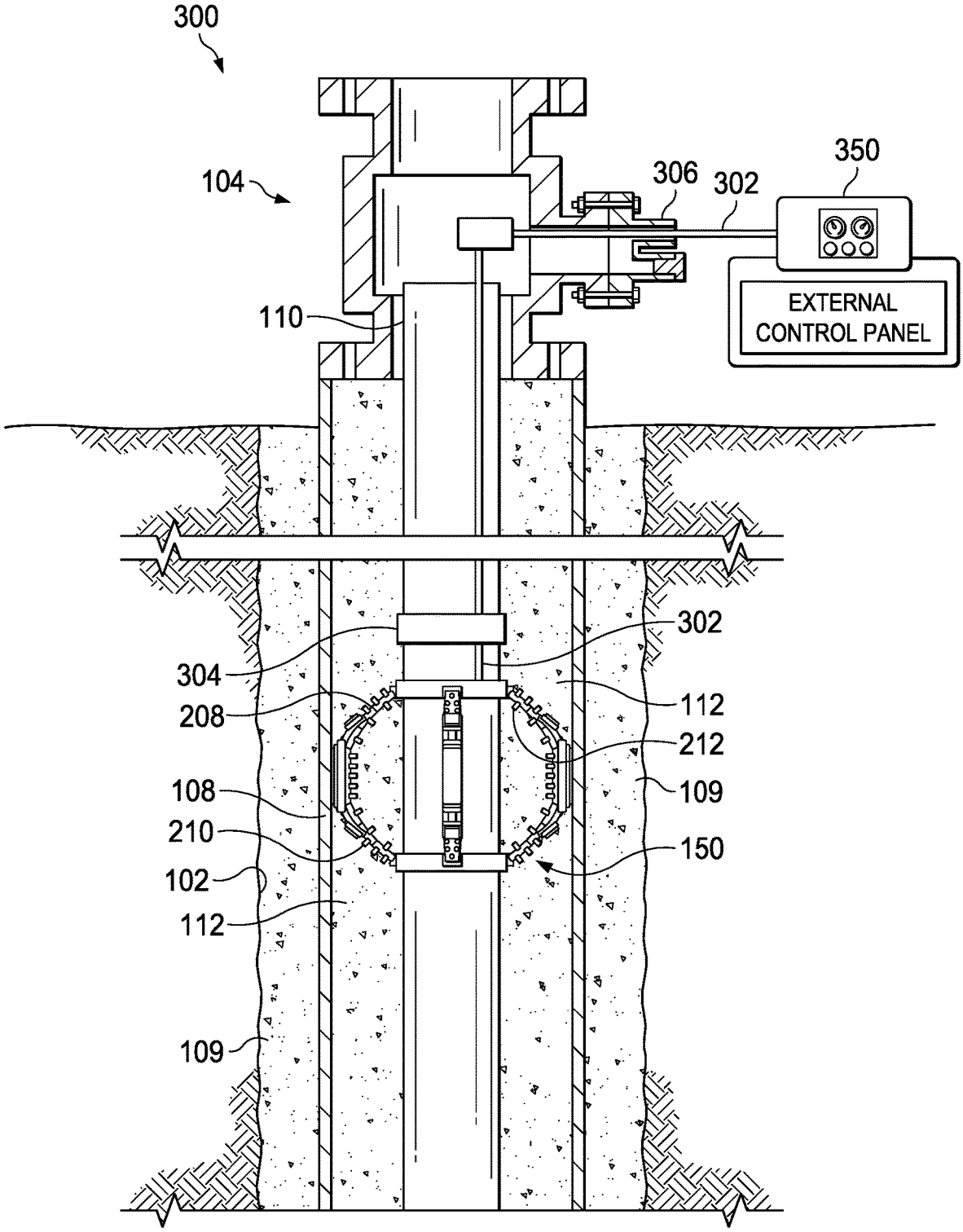
FIG. 3 is a drawing of a sealant injection system in accordance with an embodiment of the present disclosure.

FIG. 3 shows an exemplary sealant injection system 300 in accordance with an embodiment of the present disclosure. Referring to FIG. 3, and as also described in reference to FIG. 1, outer casing 108 is cemented into wellbore 102, with cement filling the annulus 109 between the exterior of outer casing 108 and the inner surface of wellbore 102. Inner casing 110 is cemented within outer casing 108, such that cement fills casing-casing annulus 112 between the exterior of inner casing 110 and the interior of outer casing 108.

Sealant injection tool 150, as described in reference to FIG. 2, is attached to the exterior of inner casing 110. A control line 302 is connected at its downhole end to the tool 150 at inlet port 206 (shown in FIG. 2). Control line 302 can be comprised of tungsten or another suitable material. In one embodiment of the disclosure, control line 302 has a minimum of 10,000 psi pressure rating. One or more intermediate clamps 304 keep control line 302 strapped closely to inner casing 110 uphole of tool 150. Control line 302 extends uphole to wellhead 104, exits wellhead 104 through side outlet flange 306, and connects to injection control system 350. Side outlet flange 306 is described in more detail in reference to FIG. 8.

Control system 350 is configured to controllably flow resin or other sealant downhole through control line 302. As shown in reference to FIG. 4, in some embodiments, control system 350 can be configured to controllably flow resin or another sealant downhole though more than one control line. In one embodiment, control system 350 comprises a high pressure/low injectivity pump with pressure sensors. Once it is decided to perform a squeeze job/sealant injection, the pump is connected to the control line 302 and sealant resin is pumped. At a pre-determined pressure, the nozzles 210 and 212 of the centralizers 208 burst and the sealant will start flowing in to the fractures, microannuli, and/or cracks within the cement within casing-casing annulus 112.

Figure 4:
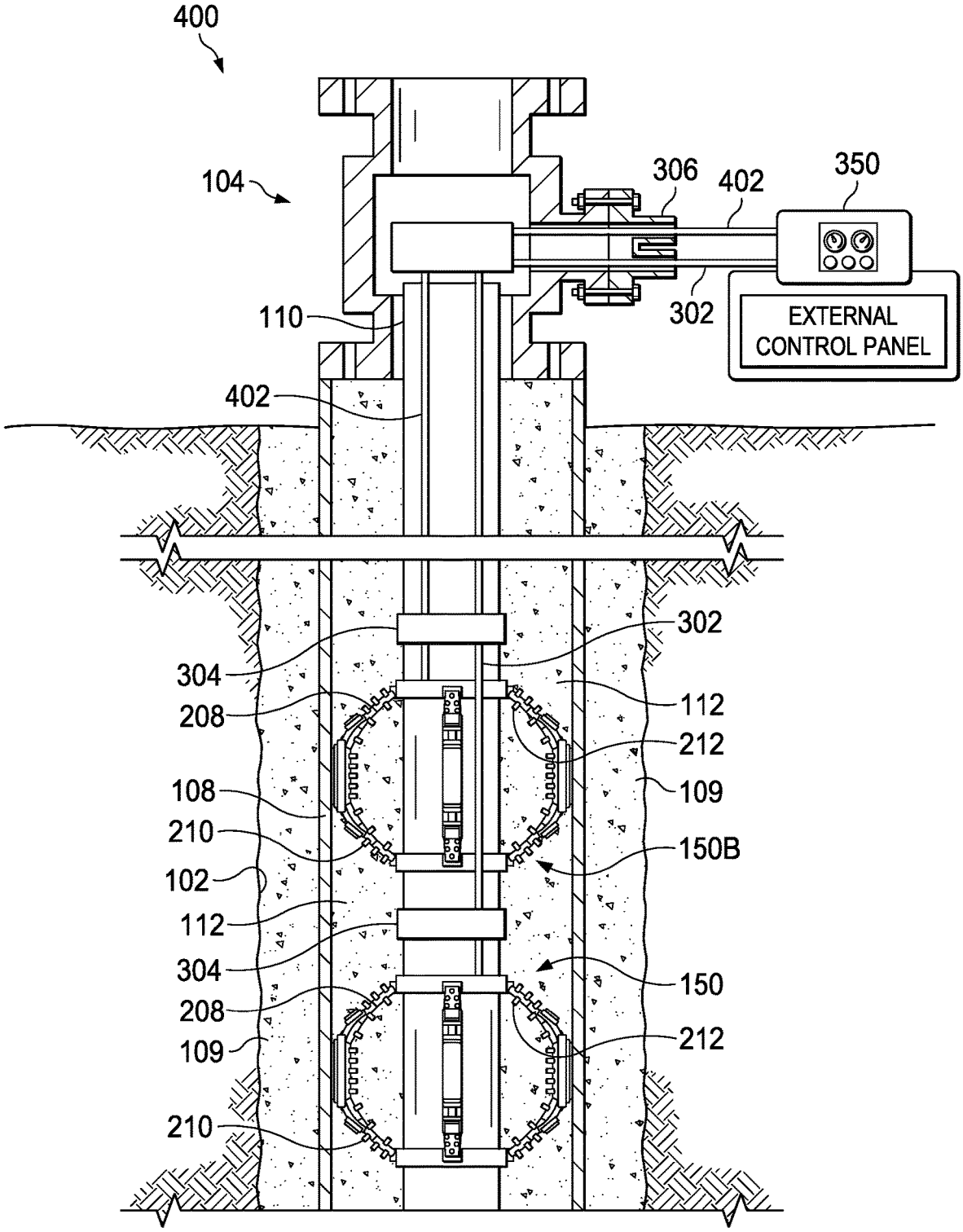
FIG. 4 is a drawing of a dual sealant injection system comprising two injection tools, in accordance with an embodiment of the present disclosure.

FIG. 4 shows an exemplary dual sealant injection system 400 in accordance with an embodiment of the present disclosure, comprising both a first and a second sealant injection tool.

Like the system 300 of FIG. 3, system 400 comprises a first sealant tool 150 attached to an inner casing 110 within the casing-casing annulus 112 between inner casing 110 and outer casing 108. Cement fills the outer annulus 109 and the casing-casing annulus 112, respectively. Control line 302 connects first sealant injection tool to control system 350.

In contrast to system 300 of FIG. 3, system 400 includes a second sealant injection tool 150B attached to the inner casing 110 uphole of first sealant injection tool 150. Sealant injection tool 150B can be configured with centralizer arms, nozzles, and the other features of sealant injection tool 150 as described in reference to FIG. 2. Second control line 402 extends uphole from sealant injection tool 150B to wellhead 104, exits the well through side outlet flange 306, and, as required, connects to injection control system 350.

One or more intermediate clamps 304 keep control lines 302 and 402 strapped closely to inner casing 110 uphole of tools 150 and 150B. Control lines 302 and 402 extend uphole to wellhead 104 and exit the wellhead through side outlet flange 306. Control system 350 is configured to flow sealant downhole through control lines 302 and 402. Control system 350 can be configured to pump sealant down control lines 302 and 402 at a controllable pressure, either simultaneously or at different times (for example, sequentially). At a pre-determined pressure, the nozzles 210 and 212 of the centralizers 208 burst and the sealant will start flowing in to the fractures, microannuli, and/or cracks within the cement within casing-casing annulus 112.

Figure 5:
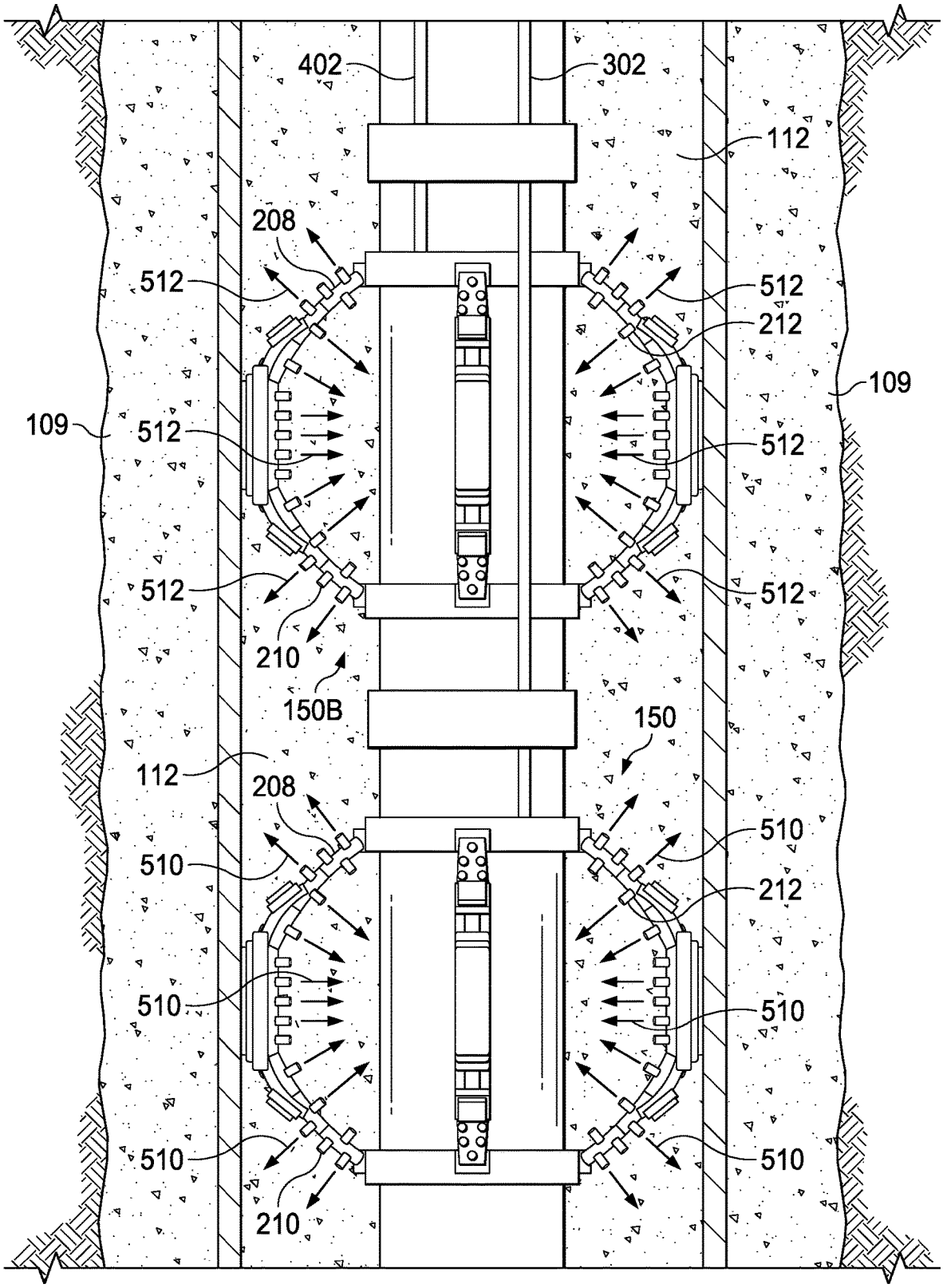
FIG. 5 is a drawing of a sealant injection system flowing sealant in accordance with an embodiment of the present disclosure.

FIG. 5 is a drawing of a sealant injection system flowing resin or another sealant in accordance with an embodiment of the present disclosure. The system shown in FIG. 5 is the dual-injection tool embodiment shown in reference to FIG. 4; however, the flow of sealant as described in reference to FIG. 5 is applicable to other embodiments as well; for example, a single-tool system as shown in FIG. 3 or a system with a different number of injection tools attached to the casing.

As shown in FIG. 5, as sealant 510 and 512 is flowed through control lines 302 and 402 and exits the nozzles from tools 150 and 150B, respectively. Centralizer arms 208 are distributed evenly from each other about the circumference of the inner casing 110 (90° apart in the illustrated embodiment), and a plurality of outer nozzles 210 face outwards and the plurality of inner nozzles 212 face inwards, thus distributing the sealant 510 and 512 evenly as it fills any small voids or microannuli in the cement that fills casing-casing annulus 112. In one embodiment, sealant can be pumped at a pressure that is 80%-90% of the burst and collapse pressure of casing 110 and casing 108, respectively.

In some circumstances, sealant 510 and 512 can be simultaneously injected from tools 150 and 150B. That is, sealant is flowed through both control lines 301 and 402 at the same time. In other circumstances, sealant can be injected first through one of tools 150 and 150B, and then sealant flowed at a later time through the other tool. For example, upon first detection or concern regarding any potential cracks or voids in the casing-casing annulus (as can be evident by pressure readings at the surface in the casing-casing annulus 112), sealant can be flowed through a first tool. If such sealant injection is successful, a second injection through the second tool can be unnecessary and/or can be delayed until subsequent detection or concern regarding additional or remaining cracks or voids. Such detection can be via pressure readings at the surface indicating higher pressures in casing-casing annulus 112. In one embodiment, side-outlet flange 306 comprises a pressure gauge configured to detect such casing-casing annulus pressure.

Figure 6:
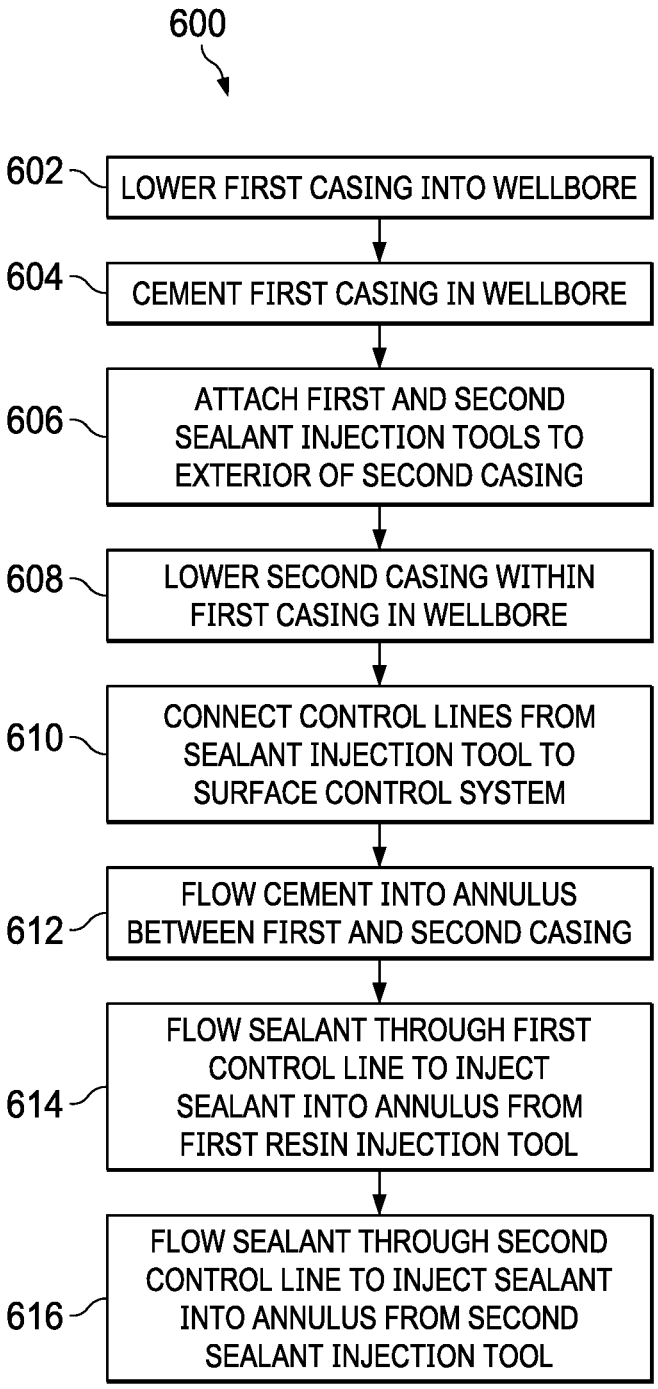
FIG. 6 is a process flow diagram of a method for sealing an annulus in accordance with an embodiment of the present disclosure.

FIG. 6 is a process flow diagram of a method 600 for sealing an annulus in accordance with an embodiment of the present disclosure. The method is described with reference to the components described in reference to FIGS. 1-5.

The method begins at block 602 with the positioning of a first, outer casing 108 within a wellbore 102. At block 604, the outer casing is cemented in the well using standard casing cementing methods.

The method continues at block 606 with the attachment at the surface of sealant injection tool(s) 150 to a second, inner casing 110 using clamps 202 and 204. In some embodiments, only one tool 150 is attached to casing 110. In another embodiment, a first tool 150 and a second tool 150B are attached to inner casing 110. In one embodiment, where flange 306 comprises a standard 2 1/16" flange, such a flange can accommodate a maximum of two control lines, and thus a maximum of two sealant injection tools can be utilized in a system with such a standard flange size. In other embodiments, utilizing different flange configurations or sizes, more than two sealant injection tools 150 can be attached to inner casing 110. Clamps 202 and 204 fit around the circumference of the inner casing and control lines 302 and 402 extend from the tools 150 and 150B.

At block 608, the inner casing 110 is lowered into the wellbore, within the outer casing 108. Control lines 302 extend from tool 150 to the surface as the tool is lowered downhole. A casing-casing annulus 112 is formed by the annular space between the outer casing 108 and the inner casing 110.

At block 610, the upper ends of the control lines 302 and 402 are extracted from the wellhead and attached or passed through side-control flange 306 and, when sealant injection is required, connected to surface control system 350. Further details regarding the control line extraction procedure are described in reference to FIGS. 7A-7D, FIG. 8, and FIG. 9. At block 612, the inner casing 110 is cemented in the wellbore using standard cementing methods.

As the cement cures or ages, small microannuli or other voids can form in the cement. At block 614, sealant is injected from the first sealant injection tool 150, filling voids within the cement in the annulus between the first and second casing.

In the embodiment wherein two injection tools 150 and 150B are attached to inner casing 110, at step 616, sealant is injected from the second sealant injection tool 150B, filling remaining or additional voids within the cement in the annulus between the first and second casing.

FIGS. 7A-7D is a drawing of a control line extraction sequence in accordance with an embodiment of the present disclosure.

Figure 7A:
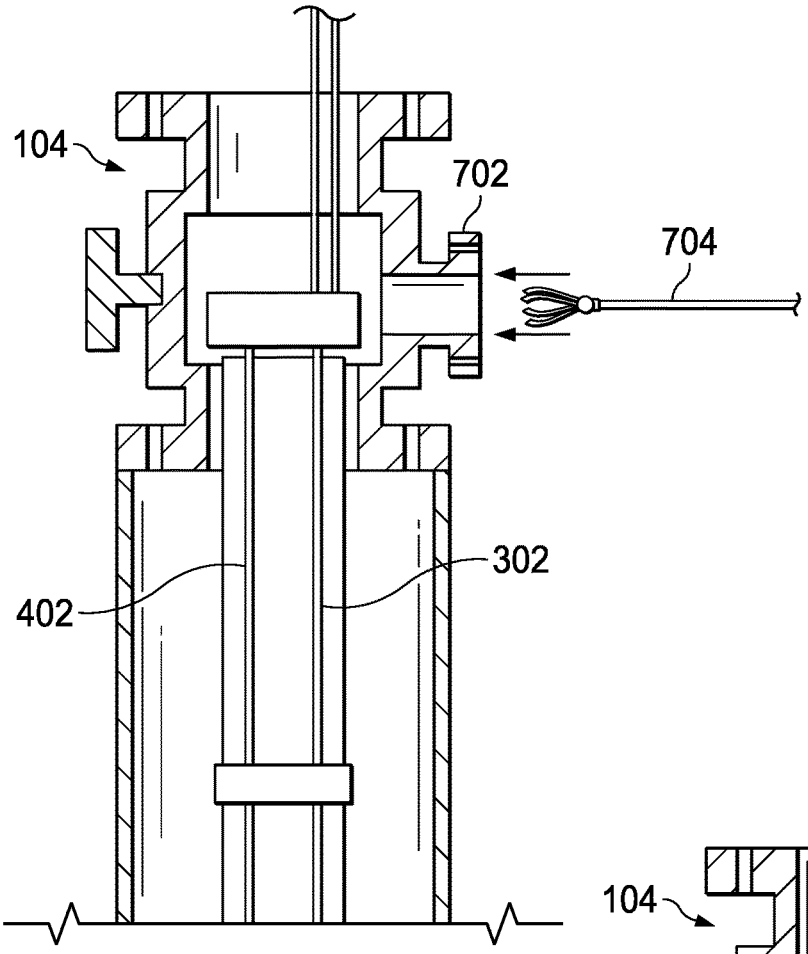
FIGS. 7A-7D is a drawing of a control line extraction sequence in accordance with an embodiment of the present disclosure.

As shown in FIG. 7A, control lines 302 and 402 extend uphole from the downhole-positioned sealant injection tools (not shown) and extend into wellhead 104. A control line extraction tool 704 is inserted into wellhead 104 via a side outlet 702. Control line extraction tool 704 is described in more detail in reference to FIG. 9.

Figure 7B:
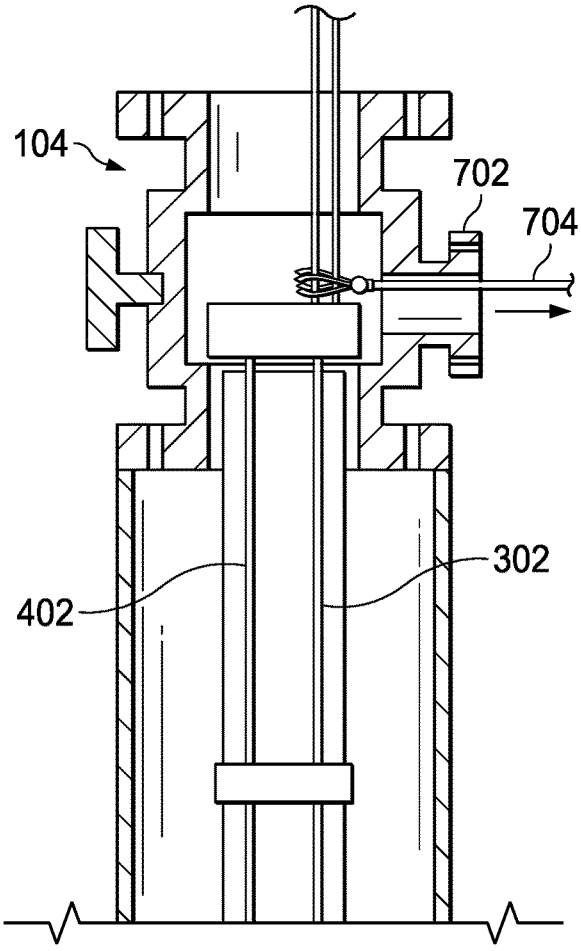

As shown in FIG. 7B, control line extraction tool 704 grabs control lines 302 and 402 and pulls control lines 302 and 402 out of wellhead 104 through the side outlet 702. Control lines 302 and 304 are cut to the required length.

Figure 7C:
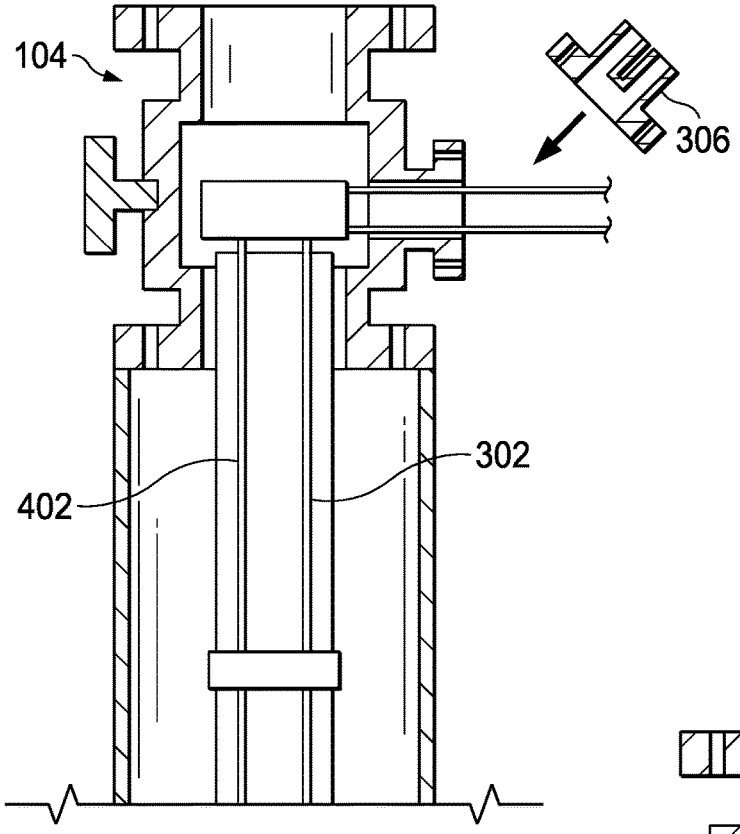
Figure 7D:
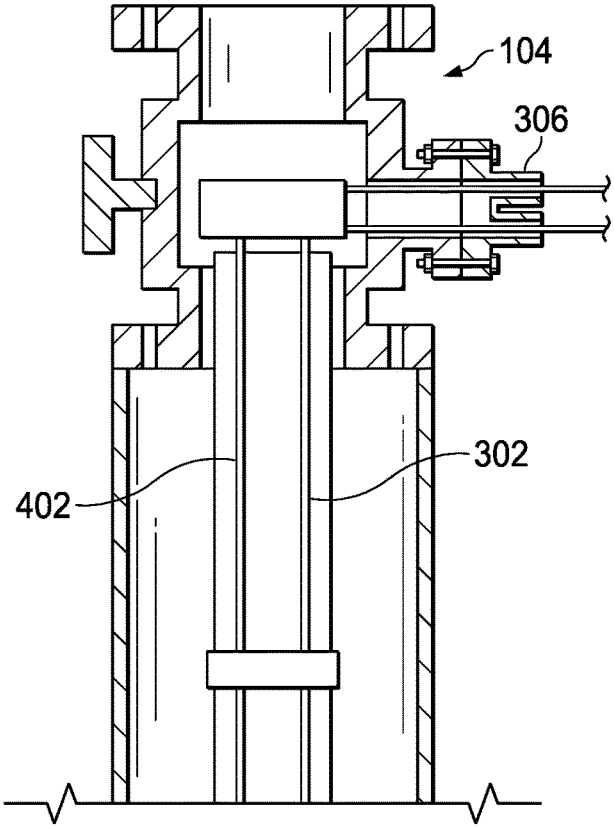

As shown in FIG. 7C, control lines 302 and 402 are inserted through side outlet flange 306. At FIG. 7D, side outlet flange 306 is secured to the side outlet, thus sealing wellhead 104 but allowing fluid flow into the wellbore via control lines 302 and 402 when required. Control lines 302 and 402 can remain closed with ½" NPT connections during normal well operations. When a squeeze job/sealant injection is required, control lines 302 and 402 can be connected to surface control system 350 (not shown).

Control lines 302 and 402 can in some embodiments comprise continuous lines from downhole tool to surface control system 350. In other embodiments, control lines 302 and 402 can comprise different segments of lines fluidically attached to each other. For example, one segment of control lines 302 and 402 can connect downhole tools 150 to side outlet flange 306, and another segment of control lines 302 and 402 can connect from side outlet flange 306 to control system 350, providing continuous fluidic connection from downhole tool to surface control system.

Figure 8:
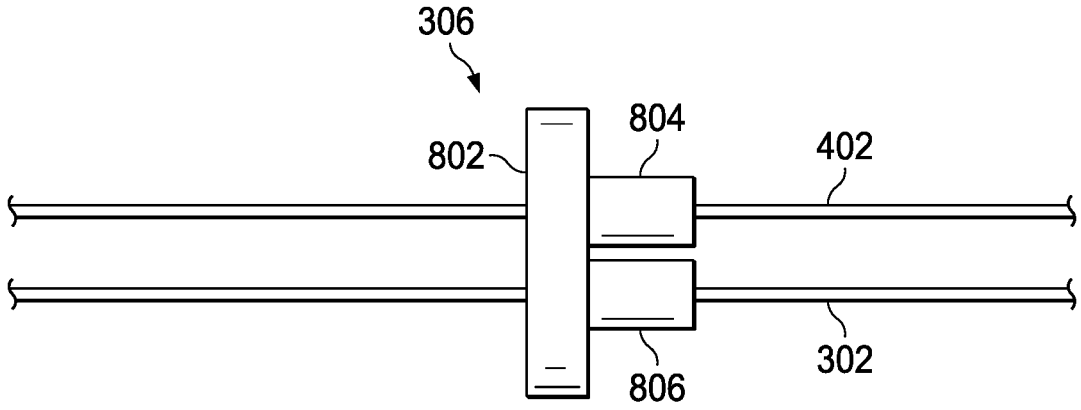
FIG. 8 is a drawing of a side outlet flange in accordance with an embodiment of the present disclosure.

FIG. 8 is a drawing of a side outlet flange 306 in accordance with an embodiment of the present disclosure.

Side outlet flange 306 comprises a main body 802 and ports 804 and 806. In one embodiment of the present disclosure, ports 804 and 806 comprise ½ inch NPT (National Pipe Tapered) connections. The side outlet flange 306 and ports 804 and 806 can have a pressure rating that is the same as control lines 302 and 402. In one embodiment of the present disclosure, side outlet flange 306 and ports 804 and 806 have a pressure rating of 10,000 psi.

Figure 9:
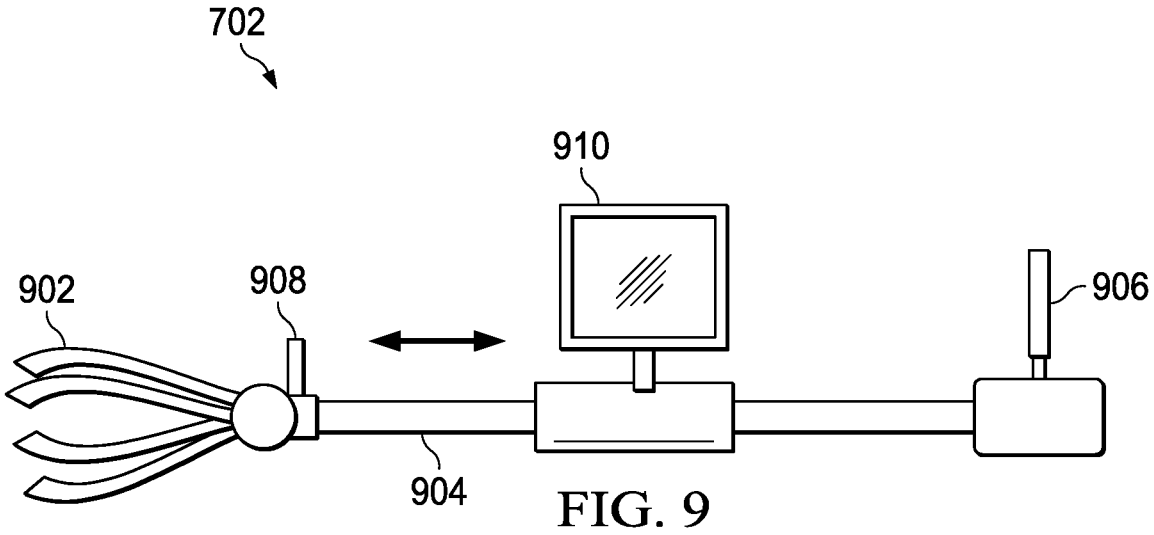
FIG. 9 is a drawing of a control line extraction tool in accordance with an embodiment of the present disclosure.

FIG. 9 is a drawing of a control line extraction tool 704 in accordance with an embodiment of the present disclosure.

Control line extraction tool 704 can be inserted into a side outlet of the wellhead (for example side outlet 702 in FIG. 7A) to allow the user to locate and grab control lines (for example, control lines 302 and 304 of FIG. 7A).

Referring to FIG. 9, control line extraction tool 704 comprises grab arms 902 attached to arm 904. Arm 904 is configured to move up, down, sideways, or forwards or backwards, in response to commands from joystick controller 906. Joystick controller 906 also allows the user to close or open grab arms 902.

Sensor unit 908 can comprise cameras and/or lights so that the user can observe the vicinity of grab arms 902 using observation screen 910. Using the information regarding control line and grab arm location exhibited on observation screen 901, the user can locate and grab the control lines. As shown in FIGS. 7A-7E, after the control lines have been grabbed by grab arms 902, control line extraction tool 704 is pulled from the outlet, pulling out control lines so that they can then be attached to a surface control system (for example, control system 350 of FIG. 3).

What is claimed is:

1. A downhole sealant injection system, comprising a first casing configured to be positioned in a wellbore;

a second casing configured to be positioned in the wellbore and to be cemented within the first casing such that cement at least partially fills an annulus between the interior of the first casing and the exterior of the second casing;

a first sealant injection tool configured to be attached to the exterior of the second casing, the first sealant injection tool configured to be positioned at a downhole location and within the annulus between the interior of the first casing and the exterior of the second casing, wherein the sealant injection tool comprises a plurality of nozzles configured to inject sealant into voids within the cement in the annulus between the interior of the first casing and the exterior of the second casing after the second casing has been cemented within the first casing.

2. The downhole sealant injection system of claim 1, wherein at least a portion of the plurality of nozzles are defined in at least one of a plurality of centralizer arms.

3. The downhole sealant injection system of claim 2, wherein the centralizer arms are hollow, and wherein an interior of the nozzles is fluidically connected to an interior of the centralizer arms.

4. The downhole sealant injection system of claim 1, further comprising a second sealant injection tool attached to the exterior of the second casing, the second sealant injection tool comprising a second plurality of nozzles configured to inject sealant into voids within the cement in the annulus between the interior of the first casing and the exterior of the second casing.

5. The downhole sealant injection system of claim 1, further comprising a first control line configured to flow sealant from a surface control system to the first sealant injection tool.

6. The downhole sealant injection system of claim 5, further comprising a second control line configured to flow sealant from the surface control system to the second sealant injection tool.

7. The downhole sealant injection system of claim 1, wherein the nozzles comprise burst discs configured to flow sealant upon an exceedance of a burst pressure.

8. The downhole sealant injection system of claim 1, wherein the sealant comprises a resin.

9. A sealant injection tool, comprising:

clamps configured to be attached to the exterior of a casing, the casing configured to be placed within a wellbore;

a plurality of centralizer arms attached to the clamps and extending radially outward from the casing;

a plurality of nozzles defined in the centralizer arms, the plurality of nozzles configured to inject sealant into a space exterior of the casing within the wellbore.

10. The sealant injection tool of claim 9, wherein the centralizer arms are hollow, and wherein an interior of the nozzles is fluidically connected to an interior of the centralizer arms.

11. The sealant injection tool of claim 9, wherein the nozzles comprise burst discs configured to flow sealant upon an exceedance of a burst pressure.

12. The sealant injection tool of claim 9, wherein a first subset of the plurality of nozzles points outward away from the casing and a second subset of the plurality of nozzles points inward towards the casing.

13. The sealant injection tool of claim 9, wherein the sealant comprises a resin.

14. A method of sealing an annulus between a first casing and a second casing, the first casing positioned within a wellbore, the method comprising:

attaching a first sealant injection tool to the exterior of the second casing, the sealant injection tool comprising a plurality of nozzles;

lowering the second casing and the sealant injection tool into the wellbore within the first casing;

cementing the second casing within the first casing by flowing cement into the [an] annulus between the interior of the first casing and the exterior of the second casing; and injecting, after the second casing has been cemented within the first casing, sealant from the nozzles, the sealant filling voids within the cement in the annulus between the interior of the first casing and the exterior of the second casing.

15. The method of claim 14, wherein a downhole end of a first control line is configured to be fluidically connected to the first sealant injection tool, and further comprising fluidically connecting an uphole end of the first control line to a surface control system.

16. The method of claim 15, further comprising flowing sealant from the surface control system through the first control line.

17. The method of claim 14, further comprising attaching a second sealant injection tool to the exterior of the second casing, the second sealant injection tool comprising a second plurality of nozzles configured to inject sealant into voids within the cement in the annulus between the interior of the first casing and the exterior of the second casing.

18. The method of claim 17, wherein a downhole end of a second control line is configured to fluidically connect to the second sealant injection tool, and further comprising fluidically connecting an uphole end of the second control line to a surface control system.

19. The method of claim 14, wherein the nozzles comprise burst discs, and further comprising applying pressure to the first control line sufficient to burst the burst discs.

20. The method of claim 14, wherein the sealant comprises a resin.

* * * * *